United States Patent [19]

Litehizer, Jr.

[11] Patent Number: 4,642,874

[45] Date of Patent: Feb. 17, 1987

[54] HAND HELD TOOL FOR WIRE INSERTION

[75] Inventor: Melvin P. Litehizer, Jr., Winston-Salem, N.C.

[73] Assignee: AMP Incorporated, Harrisburg, Pa.

[21] Appl. No.: 791,016

[22] Filed: Oct. 24, 1985

[51] Int. Cl.[4] ..... H01R 43/04

[52] U.S. Cl. ..... 29/566.4; 29/749; 29/751; 29/753

[58] Field of Search ..... 29/566.4, 566.3, 753, 29/751, 749; 72/410

[56] References Cited

U.S. PATENT DOCUMENTS

| | | | |
|---|---|---|---|
| 3,571,890 | 3/1971 | Brehm et al. | 29/566.4 |
| 3,742,571 | 7/1973 | Brehm | 29/751 X |
| 4,040,179 | 8/1977 | Sanchez | 29/751 X |
| 4,286,381 | 9/1981 | Litehizer, Jr. | 29/751 |
| 4,387,501 | 6/1983 | Rix | 29/751 X |
| 4,389,769 | 6/1983 | Casey | 29/751 |
| 4,467,516 | 8/1984 | John et al. | 29/751 X |
| 4,534,107 | 8/1985 | Maack | 29/751 |

*Primary Examiner*—Robert L. Spruill
*Assistant Examiner*—Steve Katz
*Attorney, Agent, or Firm*—Eric J. Groen

[57] ABSTRACT

A tool for manually terminating conductors of multiconductor cable into termination sections of electrical connectors. The tool terminates two wires simultaneously into two parallel opposed terminals, and automatically indexes the connector to align the insertion mechanism with the next termination sections of the connector.

17 Claims, 9 Drawing Figures

HAND HELD TOOL FOR WIRE INSERTION

BACKGROUND OF THE INVENTION

1. Field of the Invention

The invention relates to a hand held pistol grip tool used for terminating conductors in a multi-contact electrical connector.

2. Description of the Prior Art

U.S. Pat. No. 3,760,335 shows a multi-contact electrical connector, typical of use in the telecommunications industry. This connector utilizes two rows of parallel contacts for receiving conductors. Termination of the conductors requires forcing each conductor into a slot, which cuts through the insulation and terminates the conductor to the contact; better known in the industry as an insulation displacement connection.

In a tool that terminates conductors in a multi-contact electrical connector, it is desirable to have a tool which terminates two conductors simultaneously; one on either side of the parallel contacts, providing for a much quicker operation.

It is also desirable to provide for automatic indexing, such that upon termination of two conductors, the electrical connector is indexed with respect to the termination device. This provides for a quicker termination process with less possibility of operator error. Manual indexing requires the operator to manually align the termination device with the electrical contact. Misalignment could lead to terminating the conductor in the wrong terminal, or even to damaging the terminal.

It is further desirable to provide a pistol grip design over a palm grip design. Larger forces are required for terminating the conductors in the respective terminals when using a palm grip, especially when two conductors are terminated simultaneously. A pistol-grip design provides for a higher mechanical advantage and is thus more comfortable for the operator ergonomically.

U.S. Pat. No. 3,742,571 shows a pistol-grip tool for terminating conductors in a multi-contact electrical connector. This tool is for terminating one conductor at a time and requires manually indexing.

U.S. Pat. No. 4,286,381 shows a similar tool which terminates one conductor at a time and automatically indexes.

U.S. Pat. No. 4,387,501 shows a palm grip tool for terminating conductors in a multi-contact electrical connector. This tool allows for terminating two conductors at a time and for automatic indexing. This tool is for palm grip rather than pistol-grip and thus requires large hand forces for termination of conductors.

U.S. Pat. No. 4,389,769 shows a pistol grip termination tool for terminating only one conductor at a time, and indexes automatically.

U.S. Pat. No. 4,467,516 shows a pistol grip termination tool for terminating two conductors simultaneously and must be indexed manually.

U.S. Pat. No. 4,534,107 shows a pistol grip termination tool for terminating one conductor at a time, and also crimps a U-shaped strain relief portion over the conductor.

SUMMARY OF THE INVENTION

The preferred embodiment of this invention comprises a manually operated tool for inserting electrical conductors into terminating sections of electrical terminals in a multi-contact electrical connector. The tool includes a cavity within a head for receiving the connector. The preferred embodiment of the invention has two inserters, each inserter located on opposite sides of the cavity. A single stroke of the tool trims the conductors and then activates the inserters inwardly towards each other, forcing the conductors into the respective terminating sections of the electrical terminals. The same stroke causes the connector to automatically index within the receiving cavity, aligning the next two terminals with the respective inserters.

BRIEF DESCRIPTION OF THE DRAWINGS

FIG. 3 is an exploded perspective view of the inserter mechanism and the indexing mechanism.

DESCRIPTION OF THE PREFERRED EMBODIMENTS

Figure 1:
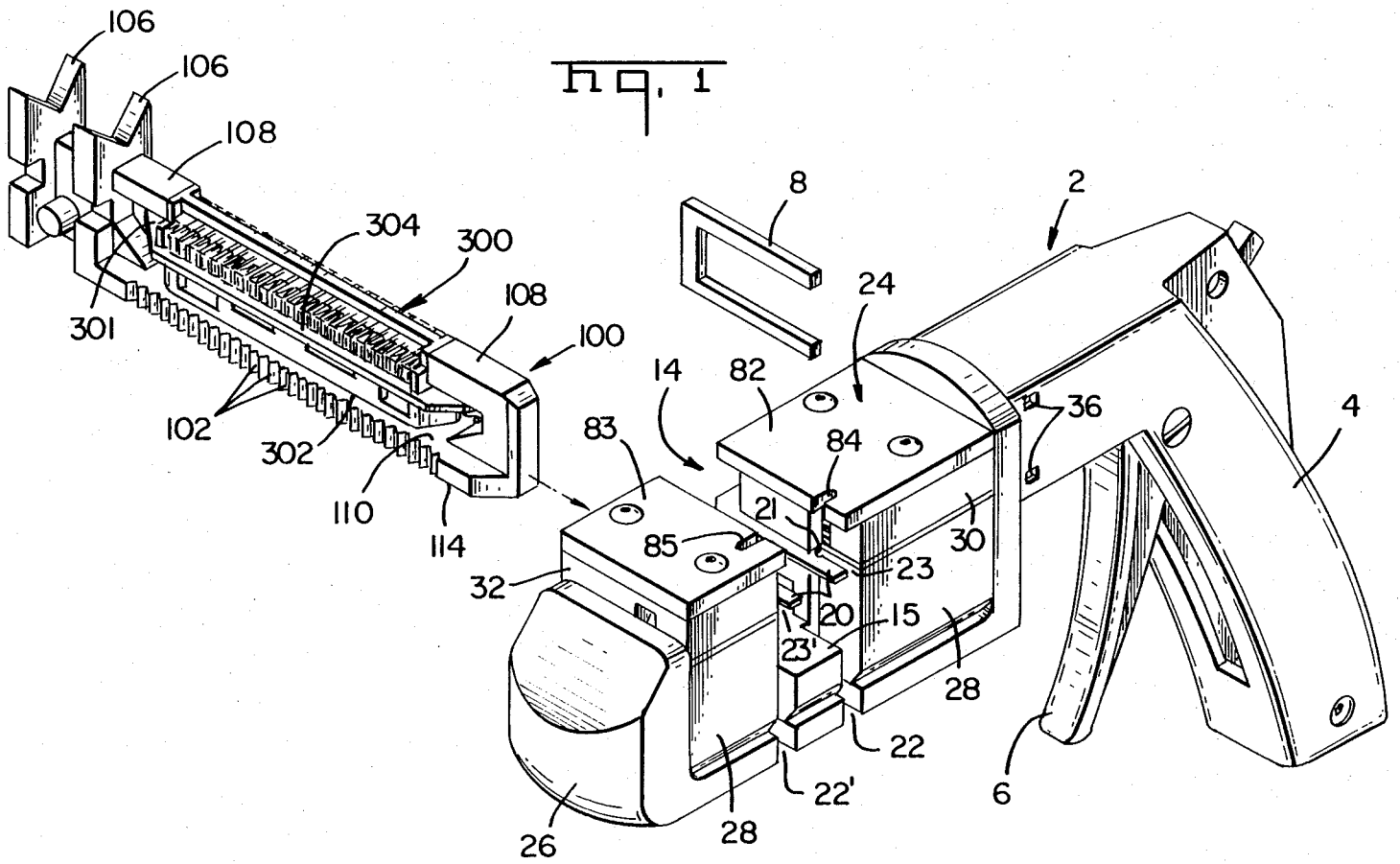
FIG. 1 is a perspective view of the subject tool and a typical insulation displacement connector exploded therefrom.

The subject tool includes a pistol grip assembly 2 and a head assembly 24. Pistol grip assembly 2 is similar to that shown in U.S. Pat. No. 4,467,516 and is incorporated herein by reference. The pistol grip assembly 22 is slidably received over the pistol grip receiving end 34, best shown in FIG. 4, and held in place by a retaining clip 8 being slidably engaged in a retaining clip receiving slot 36.

Figure 2:
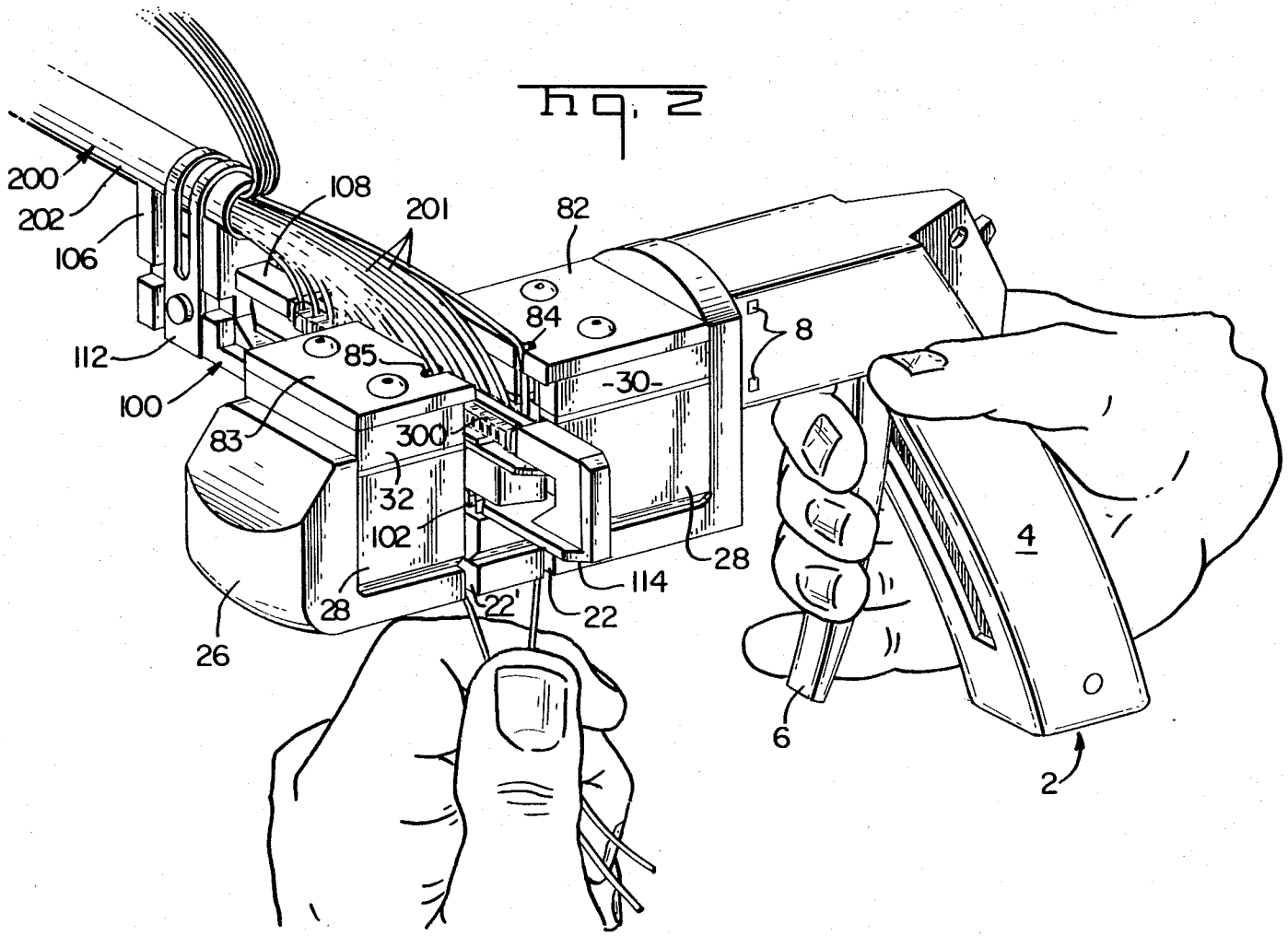
FIG. 2 is a perspective view of the subject tool with two wires ready for insertion.
Figure 4:
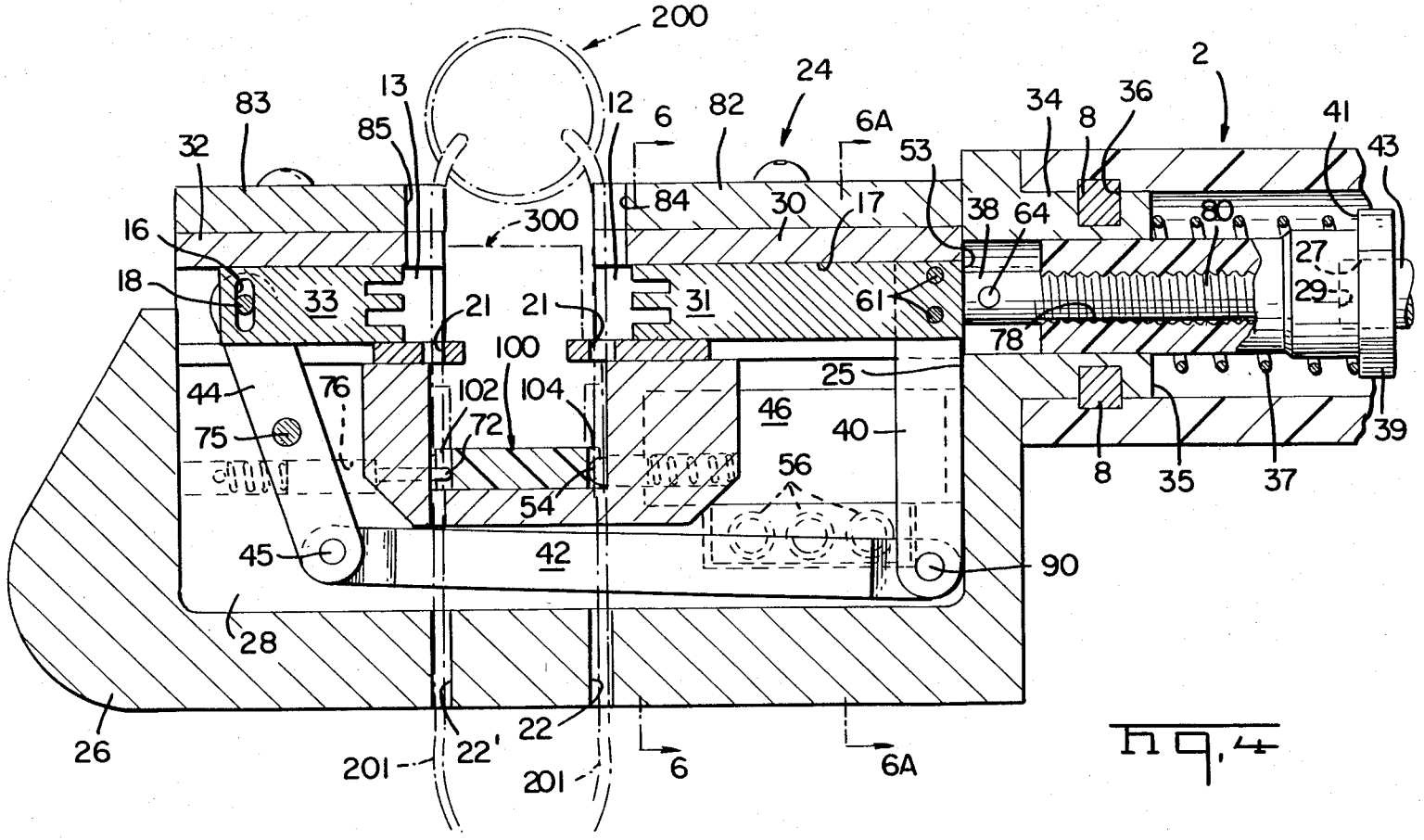
FIG. 4 is a cross-sectional view of the subject tool taken along the lines 4—4 of FIG. 6, showing the inserters in a completely retracted position.

Activation of the tool requires an operator to hold the pistol grip handle 4 as shown in FIG. 2, and depress the actuating lever 6 which is pivotally mounted to pistol grip assembly 2. As shown in FIG. 4, an internal plunger 43 within the pistol grip assembly 2 is operatively connected to actuating lever 6 and its forward end is disposed within the nut counter bore 27 of retaining nut 39. Depression of lever 6 causes the plunger 43 to engage the nut thrust surface 29 forcing the retaining nut 39 and shaft 38 forward, relative to the pistol grip receiving end 34.

Figure 5:
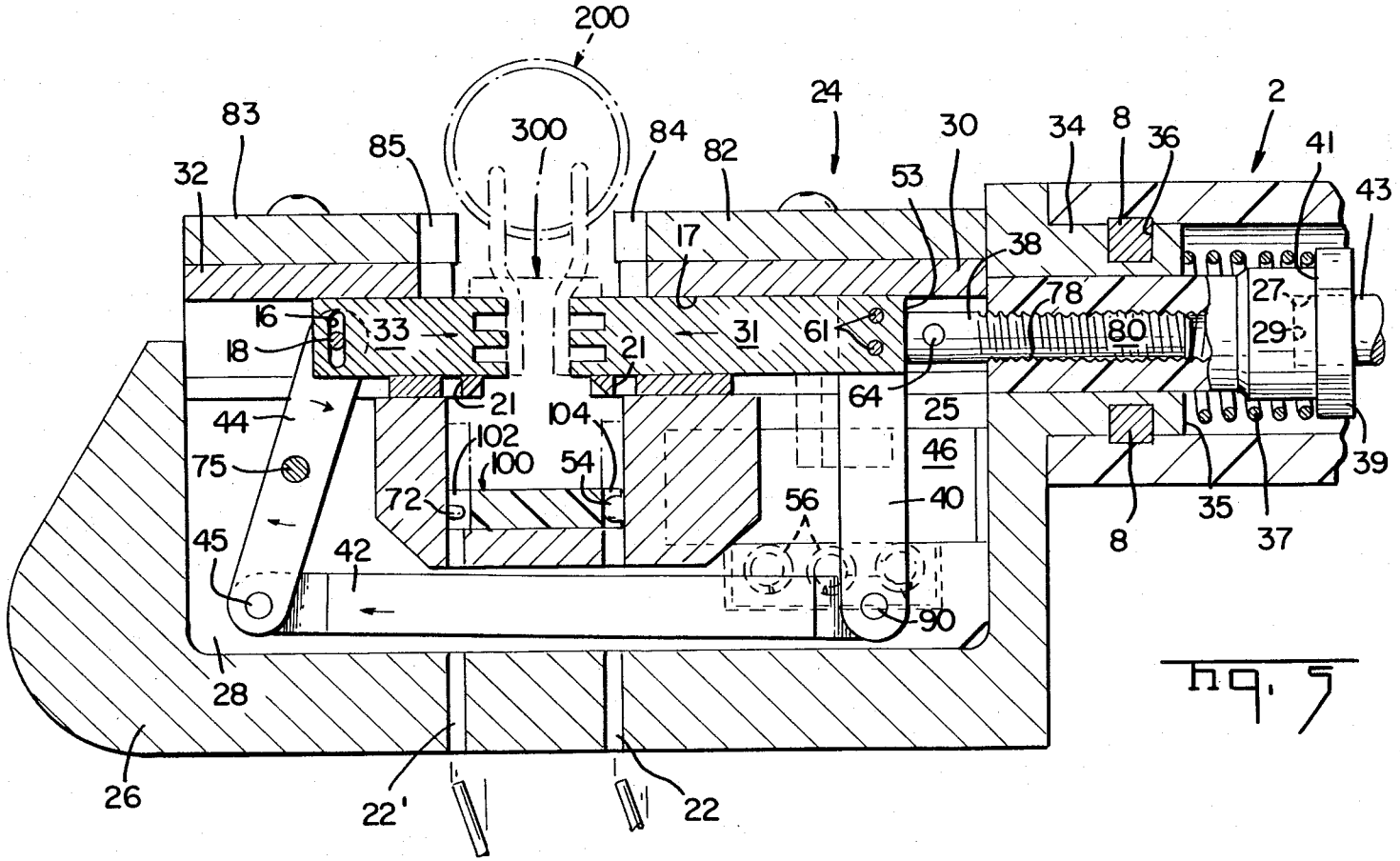
FIG. 5 is a view similar to FIG. 4 showing the inserters in the activated position, completely forward.

Proper design of a pistol grip tool requires that activation of an actuation lever causes a shaft to move forward, while release of the lever causes the shaft to retract. Referring now to FIG. 4, it can be seen that retaining nut 39 has an internally threaded portion 78 which is threaded onto an externally threaded portion 80 of shaft 38 and, thus, reciprocation of the retaining nut 39 and the shaft 38 are one in the same. Spring 37 surrounds nut 39 and is precompressed between end surface 35 and internal nut surface 41. When no force is applied to hand lever 6, spring 37 causes shaft 38 to be in the retracted position so that the rearward edge 53 of cam block 52 rests against the internal surface 25 of support block 26. Compression of handle 6 forces nut 39 and shaft 38 forward to the position shown in FIG. 5, further compressing spring 37, and releasing the handle 6 allows the compression in spring 37 to force nut 39 back to the fully retracted position.

The purpose of the tool is to terminate a plurality of conductors of a multiconductor cable in a connector having a plurality of terminals. A typical multi-contact connector is disclosed in U.S. Pat. No. 3,760,335 and is incorporated herein by reference.

In the preferred embodiment of the invention, as shown in FIG. 1, the connector 300 is mounted on the indexing carriage 100 and the carriage is received in the head cavity 14 for insertion of the conductors. The connector 300 is held onto the carriage 100 by the cantilevered action of the carriage arms 108 onto the connector end flanges 301 forcing the connector mating face 302 against the carriage ledge 110.

The multi-conductor cable 200, shown in FIG. 2, is cradled in the cable receiving means 106 and is held onto the cable receiving means by a latch 112. The cable latch 112 and the cable receiving means 106 hold the multiconductor cable 200 in a fixed position relative to the connector during termination of the conductors 201 thereof. The multi-conductor cable 200 is prepared for termination by removing the cable outer insulation 202 for a distance of at least the length of the two longest necessary conductors.

Figure 7:
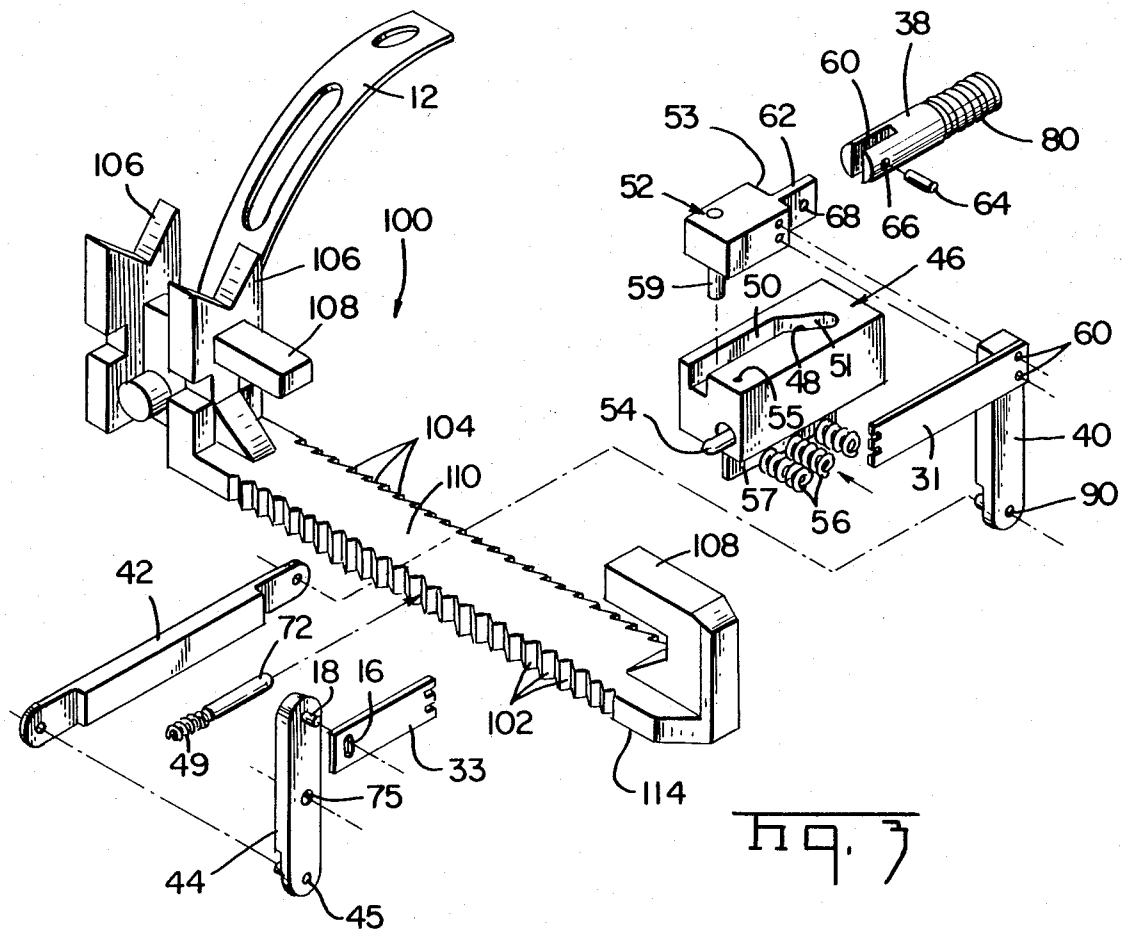
FIG. 7 is a cutaway view of the indexing mechanism relative to the connector mounting device; the indexing mechanism being shown in the retracted position.

The head cavity 14 receives and centers the connector 300 and the indexing carriage 100; the carriage bottom surface 114 rests on the cavity floor 15, while the connector side flanges 304 fit below the connector centering means 20, as best shown in FIG. 4. The conductor termination begins by inserting the indexing carriage 100 and connector 300 into the cavity 14 and pulling the indexing carriage 100 through the cavity until the inserters 31 and 33 align with the first pair of terminals; the two opposed terminals closest to the cable receiving means 106. The engagement of indexing pawl 54 with a tooth 104 and the engagement of centering pin 47 with a tooth 102, as shown in FIG. 7, ensure that the indexing carriage 100 is so aligned transversely so as to axially align the inserters 31 and 33 with the insulation displacement portion of the connector terminals.

The present invention simultaneously terminates two conductors into two terminals, the terminals being in parallel opposite rows. The first two conductors to be terminated are selected from the cable bundle 200; the first conductor is placed in conductor receiving slots 23 and 22 in head assembly 24 while the second conductor is placed in conductor receiving slots 23' and 22', respectively as shown in FIG. 2. This aligns a lengthwise segment of the first two conductors with inserters 31 and 33 respectively. Activating the tool handle 6 then trims the conductor to be terminated, terminates the conductors and indexes the carriage 100 and connector 300, aligning the next two terminals with inserters 31 and 33.

Referring now to FIG. 4, compressing the tool handle 6 causes the shaft 38 to reciprocate, activating the inserters 31 and 33, respectively. Shaft 38 is linked to cam block 52 by a tab retaining means 62 on cam block 52 being received in a slot 60 on shaft 38, as shown in FIG. 3, and a pin 64 being received in holes 66 in the shaft, and hole 68 in the tab retaining means 62. Cam block 52 reciprocates forwards and backwards under the influence of shaft 38, within channel 17 in rearguide 30, and in a straight line with respect to the direction of reciprocation.

As shown in FIG. 3, inserter 31 and vertical link 40 are attached to cam block 52 by pins 60 through inserter 31 and vertical link 40 into holes 61 in cam block 52. Thus, because of the pinned connection between cam block 52, shaft 38 and inserter 31, reciprocation of shaft 38 also causes the simultaneous reciprocation of inserter 31.

Vertical link 40 is pinned to cam block 52 by two pins 60 and therefore moves in a vertical upright position; and being connected to link 42 by pin 43, forces link 42 forward in a direction generally parallel to the plane of reciprocation. Link 42 is connected to link 44 by pin 45, and link 44 is pivotably mounted to linkage block 28 by pin 75 as shown in FIG. 4. Forward motion of link 42 under the influence of link 40 causes link 44 to pivot about pin 75. Forward inserter 33 is connected to link 44 by pin 18 in link 44 and slot 16 in inserter 33. Pivoting of link 44 causes inserter 33 to move towards the center of the cavity and towards inserter 31.

To assist in the alignment of the conductors 201 with the inserters 31, 33, rearward plate 82 and forward plate 83 are attached to rear guide 30 and forward guide 32, respectively and have conductor receiving slots 84 and 85. When the conductors 201 are selectively placed within conductor receiving slots 84, 23 and 22 and 85, 23' and 22' respectively, each conductor is axially aligned with one of the inserters 31, 33 and with a respective wire cutoff knife edge 21. As best shown in FIG. 1, each wire cutoff knife 21 compises a sharpened "V" shaped notch cut into the connector centering means 20. Compression of handle 6 first causes the inserters 31 and 33 to simultaneously begin moving towards the center of the cavity. The inserters first contact a lengthwise portion of the wires after the wires have been disposed in the receiving slots 23 and 22 and 23' and 22', respectively. The inserters then force the wires into the "V" shaped cutoff knife edge 21, trimming off the excess length of the wire. Continued forward motion of inserters 31 and 33 force the trimmed wires into the slots of the terminating sections of the terminals thereby electrically and mechanically terminating the conductors to the terminals.

The same compression of handle 6 which terminates the conductors in the respective terminals also indexes carriage 100 and connector 300 in a transverse direction with respect to the motion of shaft 38. As shown in FIG. 3, cam block 52 reciprocates linearly forward under the influence of shaft 38 and is confined within channel 17 of support block 26. Cam block 52 includes pin 59 which is slidably disposed in offset channel 51 and straight channel 50 in pawl block 46. Pawl block 46 does not move in the direction of reciprocation of cam block 52 but only transverse to the direction of reciprocation, under the influence of cam block 52 and pin 59 moving along channel 51.

Figure 6A:
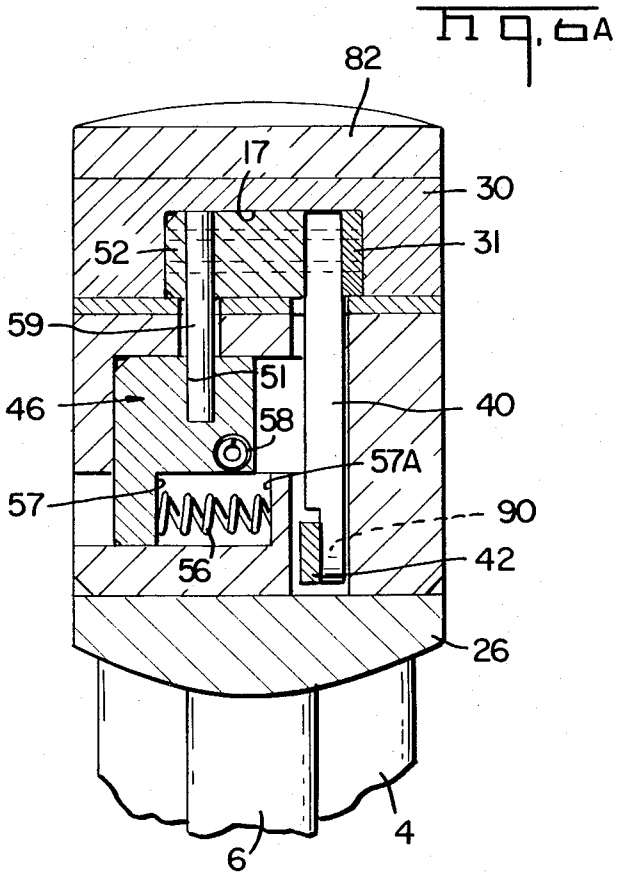
FIG. 6A is a cross-sectional view taken along the lines 6A—6A of FIG. 4.
Figure 6:
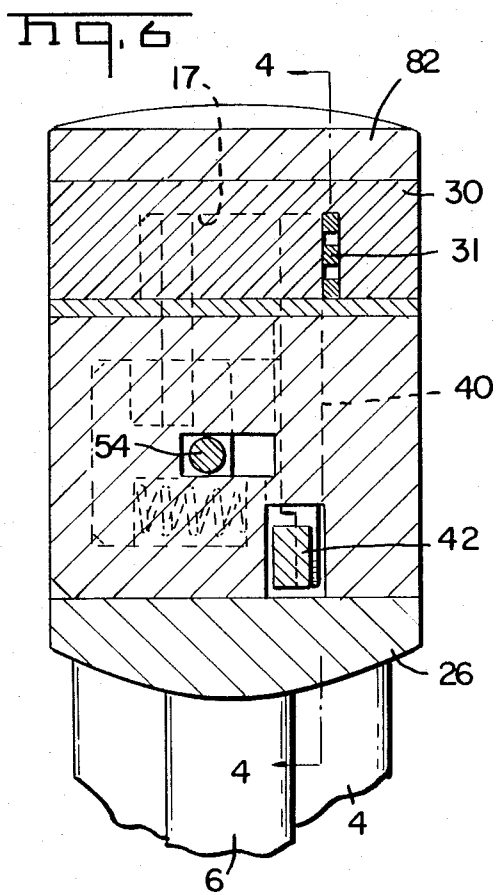
FIG. 6 is a cross-sectional view taken along the lines 6—6 of FIG. 4.
Figure 7:
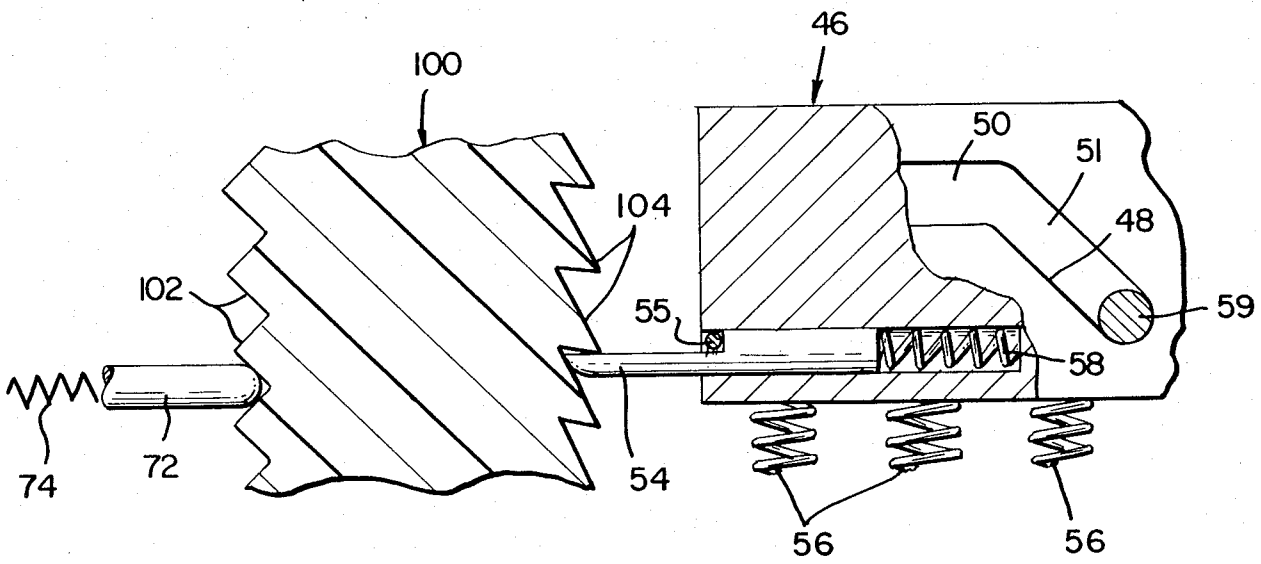
Figure 8:
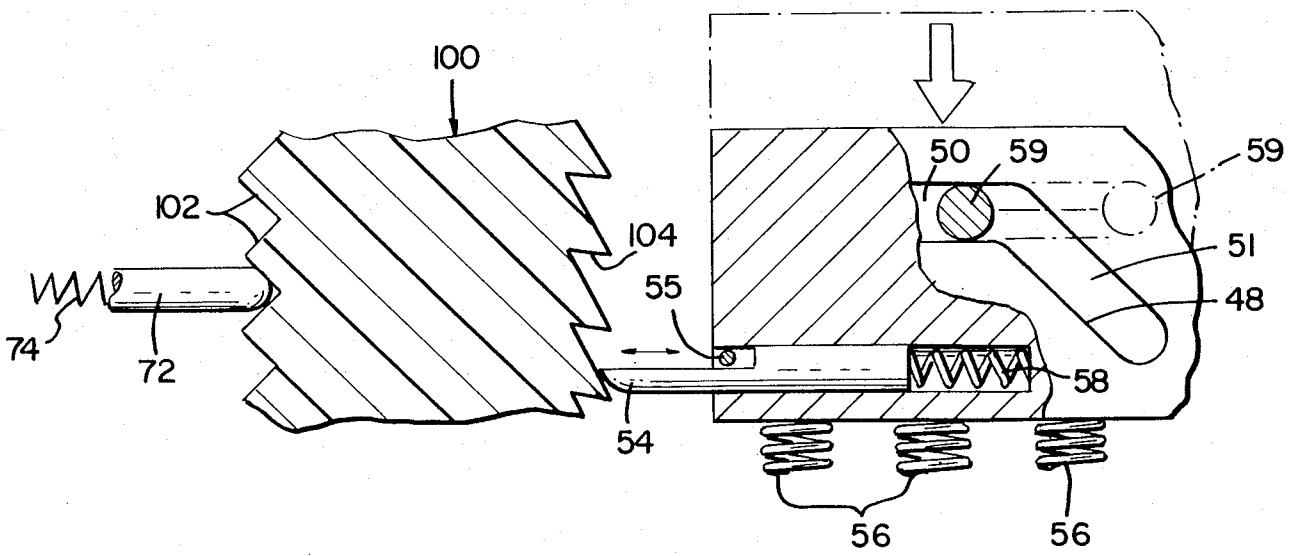
FIG. 8 is a view similar to FIG. 7, the indexing mechanism moving laterally relative to the teeth on the connector mounting device.

Forward movement of cam block 52 via shaft 38 causes pin 59 to move along channels 51, 50, thereby moving pawl block 46 in a transverse direction to that of cam block 52. This transverse movement compresses springs 56 extending between surface 57 of pawl block 46 and a surface **57*a* in block 28 as shown in FIGS. 6, 6A. At the same time that inserters 31, 33 are inserting conductors 201 into respective terminating sections of the electrical terminals, pawl 54 disposed in a channel in pawl block 46 and biased outwardly via spring 58, rides up over an adjacent tooth 104 of carriage 100 and engages the flat surface thereof. When lever 6 is released, springs 56 force pawl block 46 back to its rest position and pawl 54 indexes carriage 100 to the next position aligning inserters 31, 33 with the terminating sections of the next terminals. The transverse travel of pawl block 46 and the pitch of teeth 104 are such that one indexing cycle aligns the next two terminals with the inserters 31 and 33. Spring-biased centering pin 47 will engage respective teeth 102 on carriage 100 to center carriage 100 relative to inserters 31, 33. This operation continues until all pairs of conductors 201** are cut to length and terminated upon operation of the tool as heretofore described.

Although a preferred embodiment of the present invention is disclosed, other embodiments and modifications thereof would be apparent to one skilled in the art. For example, a variety of connector designs can be accommodated by appropriately designing the indexing carriage 100. The connector could also be designed with indexing teeth and centering teeth, such that the connector is received directly into the cavity, without the need for a connector carriage. Such other embodiments are intended to be covered by the spirit and scope of the following claims.

What is claimed is:

1. A hand tool for inserting wires into the wire receiving portions of electrical terminals of a connector with the wire receiving portions of the terminals being oppositely directed in two parallel rows, the tool comprising:

a head, a reciprocal shaft mounted in the head, means for moving the shaft from a retracted position within the head to an extended position relative to the head and means for retracting the shaft to the retracted position, said head having a cavity for receiving the connector, two inserters disposed in said head on opposite sides of the cavity for inserting wires into the wire receiving portions of the terminals, linkage means mounted in said head and comprising a first link operatively connected to the shaft, a second link attached to the first link extending below and to the opposite side of the cavity, and a third link connected to the second link and pivotably mounted to the head, the inserter means being attached to the first and third links respectively, and moveable relative to the head, towards and away from the cavity and towards and away from each other, indexing means mounted in said head for movement of the connector in a direction lateral to that of the shaft reciprocation and for sequentially positioning the terminals in alignment with the inserters.

2. The apparatus of claim 1 wherein the indexing means is operatively connected to the shaft.

3. The apparatus of claim 2 wherein the indexing means comprises camming means attached to the shaft, whereby reciprocal movement of the shaft causes movement of the indexing means, transverse to that of the shaft.

4. The apparatus of claim 1 further comprising stationary cutoff means disposed proximate to the inserter means such that the projection of the wires by the inserter means forces the wires against the cutoff means cutting the excess portion of the conductors prior to insertion thereof into the wire-receiving portions of the terminals.

5. The apparatus of claim 1 further comprising detent means in said head for aligning respective wire-receiving portions of the terminals in the connector with the inserter means.

6. A tool for inserting wires into the wire receiving portions of electrical terminals with an electrical connector, the wire receiving portions being disposed in two oppositely facing parallel rows, the tool comprising:

a head having an axial aperture therein for receiving a reciprocating shaft, and a connector receiving channel disposed within said head in a transverse relation to the axial aperture;

a reciprocal shaft disposed within said shaft receiving aperture is moveable towards and away from the connector receiving channel, from a fully retracted to a fully forward position;

first and second inserter means disposed in opposite sides of the channel facing inwardly towards a center of the channel in opposed relation, a first said inserter being connected to said reciprocating shaft and moveable into the channel when the shaft is fully forward and moveable out of the channel when the shaft is fully retracted, and a second said inserter means disposed on the opposite side of said channel directly opposed from said first inserter means, said second inserter means including means for connecting the second inserter means to the reciprocating shaft such that upon reciprocation forward of the shaft the second inserter means projects into the channel towards the first inserter means and retracts out of the channel when the shaft is fully retracted; whereby upon placement of the connector into the channel, such that the wires to be terminated and the wire receiving portions to receive the wires are aligned with the inserter means, reciprocation forward of the shaft simultaneously projects both inserters inwardly thereby forcing the wires into respective wire receiving portions of the terminals, and retraction of the shaft retracts both inserter means out of the channel.

7. The tool of claim 6 wherein the connecting means for the second inserter includes includes a first linkage connected to the shaft, a second link being pivotally connected at a first end to the first link, the second link being disposed below the channel, and a third link pivotally connected to a second end of the second link, and pivotally connected to the head, such that forward reciprocation of the shaft, causes forward motion of the the first and second links, and a rotation of link three about the pivot point on the head, the third link being connected to the second inserter means to impart linear movement of the second inserter means in a direction opposite to that of the first inserter means.

8. The tool of claim 7 wherein the first link is fixedly connected to the shaft and extends vertically downward from the shaft and relative to the shaft, the second link extends in a substantially horizontal manner relative to the shaft, and the third link being connected extends generally vertically upward from the second link, the third link connected to the second link at a lower end and connected to the second inserter means at an upper end.

9. The tool of claim 8 wherein the pivot point on the third link is substantially centrally located between the upper and lower pivot points such that movement of the second link and the lower portion of the third link forward causes an equal movement of the upper portion of the third link in the opposite direction.

10. The tool of claim 7 further comprising an indexing means mounted in the head for movement of the connector laterally of the shaft along the channel.

11. The tool of claim 16 further comprising a connector receiving carriage for mounting a connector thereto, the carriage being receivable in said connector receiving channel.

12. The tool of claim 11 wherein the carriage comprises linear gear teeth along one side thereof.

13. The tool of claim 12 wherein the indexing means indexes the connector along the channel such that for each reciprocation cycle of the shaft, the connector is indexed laterally to the next respective terminal.

14. The tool of claim 13 wherein the indexing means comprises two block members, a first block member connected to the shaft and reciprocating therewith, the first block having a pin extending downwardly from the lower block, the second block having a slot on an upper surface thereof extending orthoginally relative to the shaft for receiving said pin therein and a pawl engageable with the teeth on said carriage for laterally indexing the connector during reciprocation of the shaft.

15. The tool of claim 6 wherein the head further comprises means to receive and align the wires to be terminated with the inserters.

16. A wire insertion assembly for inserting wires of a multiconductor cable into respective wire receiving portions of electrical terminals disposed in two parallel rows with the wire receiving portions facing outward, the tool comprising a head portion and a carriage portion, the head portion having an axial aperture therethrough, and a transverse channel for receiving said carriage portion, the head portion further comprising plural inserters disposed on opposite sides of the channel and means for linking said inserters to a reciprocating shaft disposed in said axial aperture to actuate the inserters upon reciprocation of the shaft, each inserter being projected inwardly towards each other, and towards a center of the channel; the carriage being profiled to mount a multi-terminal connector therein, and profiled to be laterally slidable into the channel for the insertion process and axially fixed during the insertion process; whereby upon assembling a connector into the carriage and inserting the carriage into the channel from a first side of the channel, the wires to be inserted and the terminals to receive the wires may be aligned with the inserters, and the shaft may be reciprocated forward causing the inserters to insert the wires into opposites sides of the connector and the shaft may be retracted to withdraw the inserters from the channel and away from the connector, the process continuing until all terminals are loaded, the carriage and connector then being removable from the head portion from the side of the channel opposite the first side.

17. The assembly of claim 16 wherein the head portion further comprises means for detenting the carriage with respect to the inserters to assure alignment between the inserters and the terminals.

* * * * *